US005433415A

United States Patent [19]

Samson et al.

[11] Patent Number: 5,433,415

[45] Date of Patent: Jul. 18, 1995

[54] ADJUSTABLE BOOK HOLDER

[75] Inventors: Daniel Samson, Newburgh, Ind.; André Corriveau, Rock Forest, Canada

[73] Assignee: Corsam Industries Inc., Rock Forest, Canada

[21] Appl. No.: 299,605

[22] Filed: Sep. 1, 1994

[51] Int. Cl.[6] ..... A47B 97/04

[52] U.S. Cl. ..... 248/448; 248/451

[58] Field of Search ..... 248/448, 452, 453, 451, 248/459, 444.1, 447.2; 281/49

[56] References Cited

U.S. PATENT DOCUMENTS

| | | | |
|---|---|---|---|
| 290,381 | 12/1883 | Wood | 248/452 |
| 556,650 | 3/1896 | Smith | 248/448 |
| 1,011,707 | 12/1911 | Ankeny | 248/452 |
| 1,228,595 | 6/1917 | Plamondon | 248/453 |
| 1,336,275 | 4/1920 | Boyer | 248/448 |
| 1,392,200 | 9/1921 | Nakoney . | |
| 1,576,154 | 3/1926 | Steinman | 248/448 |
| 1,590,726 | 6/1926 | Corsgren . | |
| 1,888,773 | 11/1932 | Ruelland | 248/452 |
| 2,774,177 | 12/1956 | Murgia | 45/60 |
| 3,031,795 | 5/1962 | Frost | 248/452 |
| 3,076,285 | 2/1963 | Sparkman | 45/85 |
| 3,215,482 | 11/1965 | Litke | 312/233 |
| 3,905,573 | 9/1975 | Davis | 248/445 |
| 4,275,863 | 6/1981 | Hartman | 248/448 |
| 4,448,384 | 5/1984 | Jones | 248/448 X |
| 4,470,571 | 9/1984 | Hartman | 248/452 |
| 4,925,144 | 5/1990 | White | 248/445 |
| 5,149,046 | 9/1992 | Kerley | 248/453 |

FOREIGN PATENT DOCUMENTS

| | | | |
|---|---|---|---|
| 43089 | 2/1893 | Canada . | |
| 87098 | 3/1904 | Canada . | |
| 120520 | 9/1908 | Canada . | |
| 1244312 | 11/1988 | Canada . | |
| 118755 | 4/1947 | Sweden | 248/451 |

*Primary Examiner*—J. Franklin Foss

*Attorney, Agent, or Firm*—Merchant & Gould; Smith, Edell, Welter & Schmidt

[57] ABSTRACT

An adjustable book holder is disclosed herein. It includes a book resting frame with horizontally extending book brackets, a vertical adjustment system, and a vertically adjustable telescopic structure to hold and right and left pages with a rack-and-pinion drive system for operating the page holders.

8 Claims, 6 Drawing Sheets

ADJUSTABLE BOOK HOLDER

BACKGROUND OF THE INVENTION a) Field of the Invention

The present invention relates to an adjustable book holder.

b) Brief Description of the Prior Art

Book holders are known per se and already form the subject matter of a few patents.

Thus, Canadian patent No. 96538 of E. Power et al. granted on Nov. 23, 1905, describes a book holder for supporting and holding covers of a book while pages thereof are retained in an open position. The book holder comprises a frame for the opened book covers to lay upon and fingers for retaining the covers in position. Also, the book holder comprises bearing brackets extending lengthwise from the frame, rock-shafts carried in the brackets, and presser-feet for retaining the pages of the book in the open position, each one of the presser-feet fixed at one end of the corresponding rock-shaft. Furthermore, the book holder comprises springs to rock the shafts and maintain the presser-feet in pressure contact with the opened pages of the book, and mechanism for simultaneously rocking the rock-shafts against the action of the springs to raise the presser-feet from the pages of the book.

Also known in the art, there are the following patents which describe different adjustable book supporting devices:

Canadian Patent Nos.: 43,089 of J. W. ZAVADIL, granted on Feb. 22, 1893; 87,098 of P. PETTIT, granted on Mar. 2, 1904; 120,520 of A. MORAND, granted on Sep. 26, 1908; 1,244,312 of F. COTE, granted on Nov. 8, 1988;

U.S. Pat. Nos.: 1,392,200 of J. A. NAKONEY, granted on Sep. 27, 1921; 1,590,726 of B. CORSGREN, granted on Jun. 29, 1926; 2,774,177 of J. B. MURGIA, granted on Dec. 18, 1956; 3,076,285 of V. M. SPARKMAN, granted on Feb. 5, 1963; 3,215,482 of B. J. LITKE, granted on Nov. 2, 1965; 3,905,573 of J. M. DAVIS, granted on Sep. 16, 1975; 4,275,863 of D. A. HARTMAN, granted on Jun. 30, 1981; and 4,925,144 of D. E. WHITE, granted on May 15, 1990.

If the known book holders are interesting, they all have the common drawback of not having the necessary means for firmly holding a book in a predetermined position while allowing pages thereof to be easily turned.

OBJECTS AND SUMMARY OF THE INVENTION

It is therefore an object of the present invention to provide an adjustable book holder that is so devised as to firmly hold a book in a predetermined position while allowing pages thereof to be easily turned.

It is another object of the present invention to provide an adjustable book holder that can readily be adjusted to any size of books, magazines or other.

In accordance with the present invention, the above objects are achieved with an adjustable book holder which comprises a book resting frame including two horizontally extending book supporting brackets, and means for vertically adjusting at least one of the brackets with respect to the other.

The book holder also comprises a vertically adjustable telescopic left page holder rotatably connected to the frame and having two opposite extremities, at least one of the extremities being provided with a horizontally adjustable book holding finger for retaining left side pages onto the book resting frame, and a vertically adjustable telescopic right page holder rotatably connected to the frame and having two opposite extremities, at least one of the extremities being provided with a horizontally adjustable book holding finger for retaining right side pages onto the book resting frame.

Means are provided for supporting the book resting frame in a predetermined position.

The book holder further comprises means mounted on the frame for opening and closing the right and left page holders. These means include a lever connected to one of the page holders for opening the same, a first horizontally extending rack having one end operatively connected to the one page holder via one pinion and another opposite end extending toward the other one of the page holders.

The means for opening and closing also include a second horizontally extending rack in line with the first rack, the second rack having one end operatively connected to the other one of the page holders via a set of two intermeshed pinions and another opposite end extending toward the one page holder and located at a predetermined distance away from the opposite end of the first rack for pushing against the same.

The means for opening and closing further include spring means for permanently biasing the page holders back to a closed position where the fingers bear against the frame or the book resting on it when the lever is released after it has been pulled, each spring means being connected between the corresponding page holder and the book resting frame.

In operation, when the aforesaid lever is pulled, the second rack slides on the frame, and its opposite end pushes against the adjacent opposite end of the first rack and the predetermined distance between the opposite ends allows a delay in the opening of the other one of the page holders.

Preferably, the book resting frame comprises a first book resting frame member including one of the two book supporting brackets and provided with two vertically extending guiding slots, and a second book resting frame member including the other one of the book supporting brackets and having two opposite ends; and the adjusting means comprise the two guiding slots provided in the first frame member and the two ends of the second frame member that are slidably mounted within the corresponding guiding slots and frictionally engage with the same.

Also, preferably, the aforesaid one page holder is the right page holder, the aforesaid other one of the page holders is the left page holder and the lever is connected to the right page holder, thereby allowing a right-handed person to use the adjustable book holder.

Furthermore, preferably, the aforesaid one page holder is the left page holder, the aforesaid other one of the page holders is the right page holder and the lever is connected to the left page holder, thereby allowing a left-handed person to use the adjustable book holder.

BRIEF DESCRIPTION OF THE DRAWINGS

In order to impart full understanding of the manner in which these objects of the invention are achieved, a non-restrictive description of a preferred embodiment thereof will be given hereinafter with reference to the accompanying drawings, wherein.

DESCRIPTION OF A PREFERRED EMBODIMENT

Figure 1:
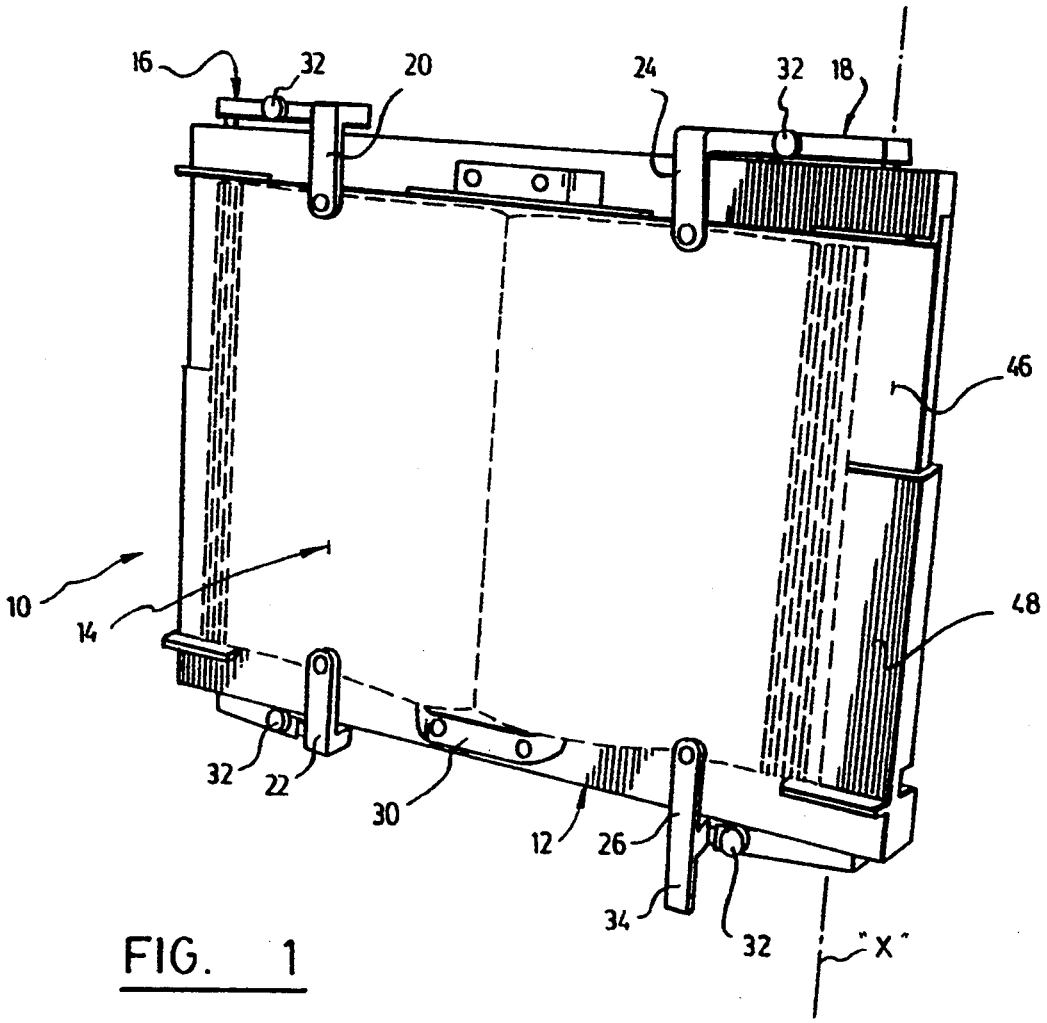
FIG. 1 is a perspective view of an adjustable book holder according to the present invention holding a book.

In the following description and in the drawings, the same numerals will refer to the same elements.

The adjustable book holder 10 according to the present invention as shown in the accompanying drawings is intended to be used to hold a book 14, a magazine or other, in an open position onto a book resting frame 12. This book resting frame 12 comprises a first book resting frame member 48 (shown clearly in FIG. 6) provided with a first horizontally extending book supporting bracket 30 and with two vertically extending guiding slots, respectively numbered 54 and 56. The book resting frame 12 also comprises a second book resting frame member 46 provided with a second horizontally extending book supporting bracket 28. This second book resting frame member 46 has two opposite ends, 50 and 52, which are slidably mounted within the aforesaid guiding slots and frictionally engage with the same. As shown, stoppers, 68 and 70, are provided, for restricting the vertical movement of the second book resting frame member 46.

Figure 6:
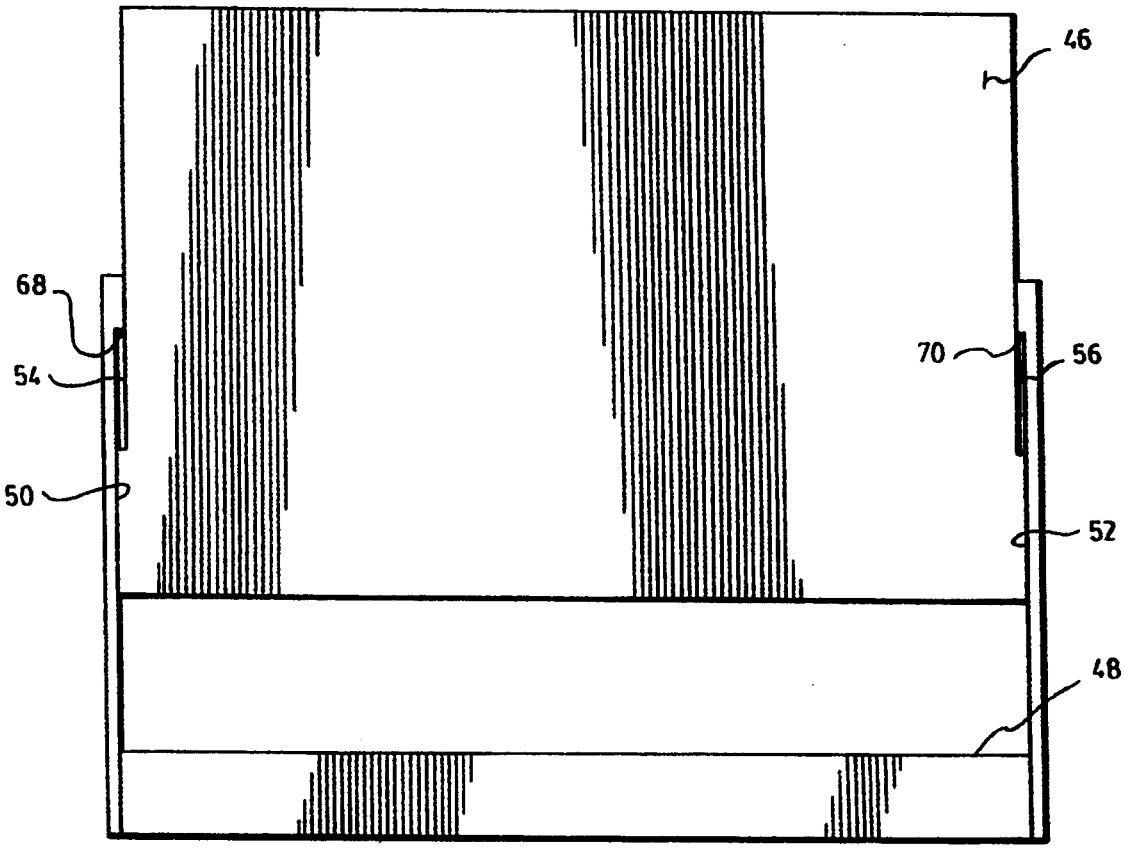
FIG. 6 is a front view of the book holder of FIG. 1 showing the book supporting brackets thereof adjusted to the size of the book.

In operation, as shown in FIG. 6, the two book supporting brackets 28 and 30 of the corresponding book resting frame members 46 and 48 are adjusted to the width of the book 14.

The book holder 10 also comprises a vertically adjustable telescopic left page holder 16 rotatably connected to the frame 12. The left page holder 16 has two extremities, each of which is provided with a horizontally adjustable book holding finger, 20 and 22, for retaining the left side pages of the book 14 onto the book resting frame 12. The book holder 10 further comprises a vertically adjustable telescopic right page holder 18 rotatably connected to the frame 12. This right page holder 18 has two opposite extremities, each of which is provided with a horizontally adjustable book holding finger, 24 and 26, for retaining the right side pages of the book 14 onto the book resting frame 12. In order to allow a rotating movement of the left or right page holder 16 or 18, the telescopic members 72 of each page holder (see FIGS. 4*a* and 5) have square cross-sections and the corresponding sleeve members 74 have channels shaped to receive these telescopic members 72. However, as can be apparent to those skilled in the art, instead of having square cross-sections, the telescopic members 72 could have rectangular or hexagonal cross-sections and the sleeve members 74 can be shaped to receive the same, to allow the rotating movement of the left or right page holders. Moreover, the sleeve members 74 could also be of circular cross-section but provided with slots therein for receiving keys to prevent rotational displacement of the telescopic members 72 within the corresponding sleeve members, thereby allowing the aforesaid rotating movement of both members in unison.

Figure 4A:
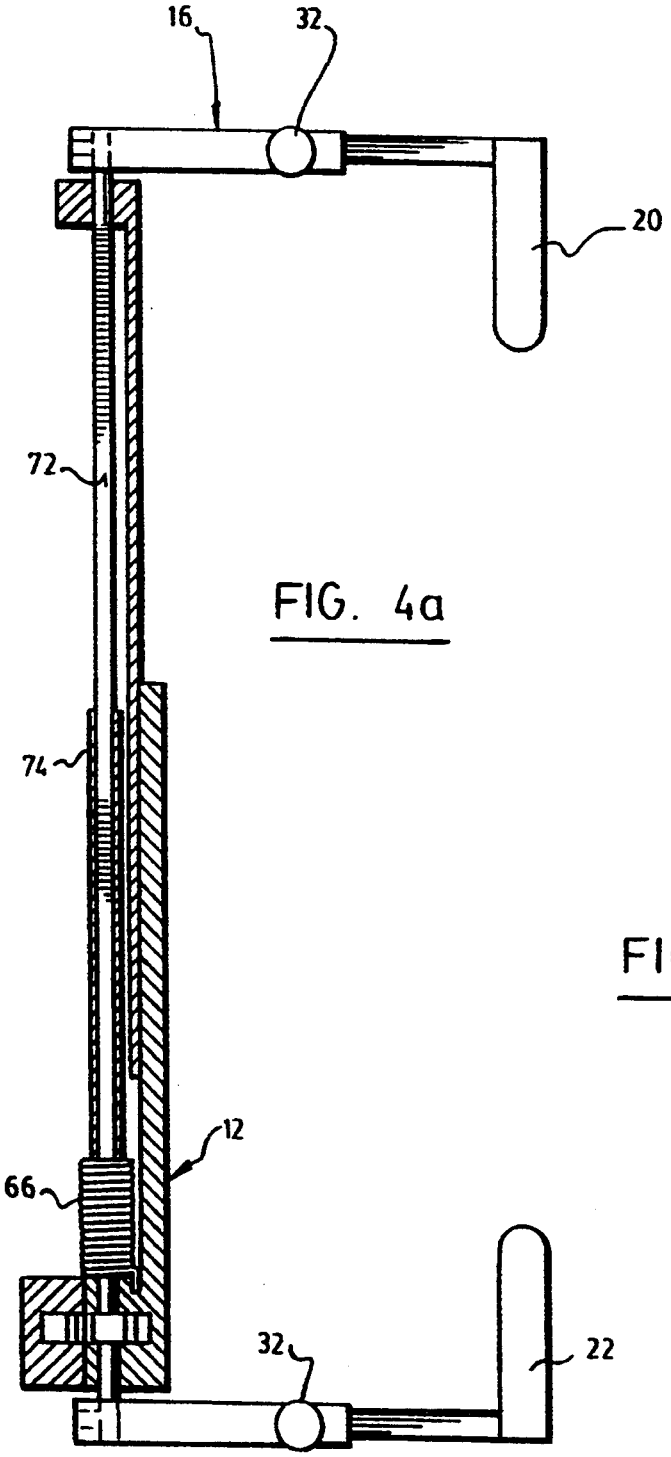
FIGS. 4*a* and 4*b* are partial front cross-sectional views of the book holder of FIG. 1 showing a vertically adjustable telescopic left page holder thereof in a retracted and an expanded position respectively.
Figure 4B:
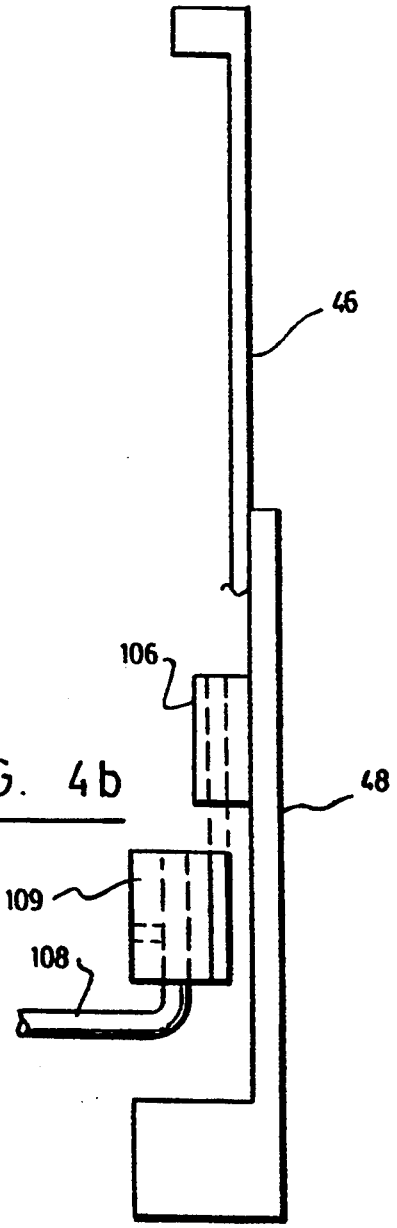

As shown in FIGS. 1 and 4*a* horizontal adjustment of the telescopic book holding fingers 20, 22, 24 and 26, is accomplished with the help of adjustment screws 32. In operation, loosening of each screw 32 allows the user to pull out or pull in the telescopic member of the corresponding book holding finger to adjust to the size of the book 14. Thereafter, retightening of the screw 32 allows the telescopic member of the finger to be firmly held at the desired horizontally adjusted position.

As can be seen, only the extremity of the left page holder 16 provided with the book holding finger 20 and the extremity of the right page holder 18 provided with the book holding finger 26 are actually used for retaining the pages of the book 14 onto the book resting frame 12.

Figure 3A:
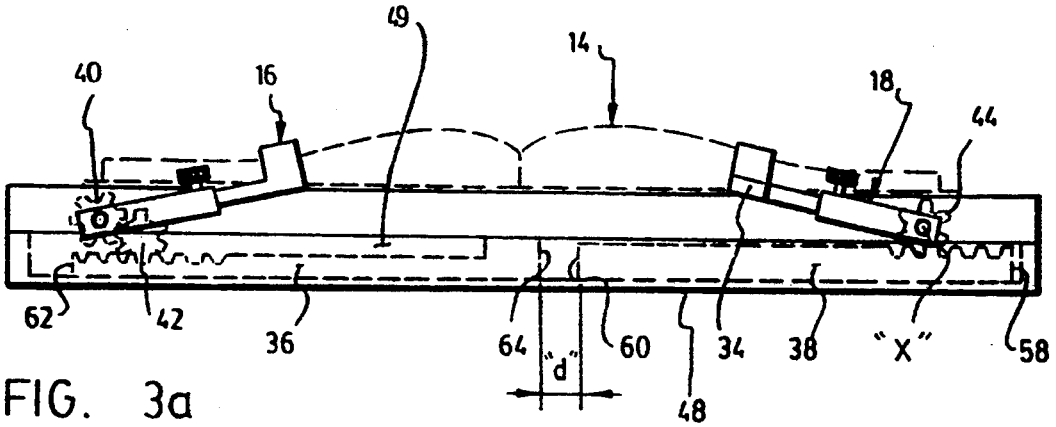
FIGS. 3*a*, 3*b* and 3*c*, are cross-sectional bottom views of the book holder of FIG. 1 showing a mechanism thereof for opening and closing the right and left page holders in different successive operative positions.
Figure 3B:
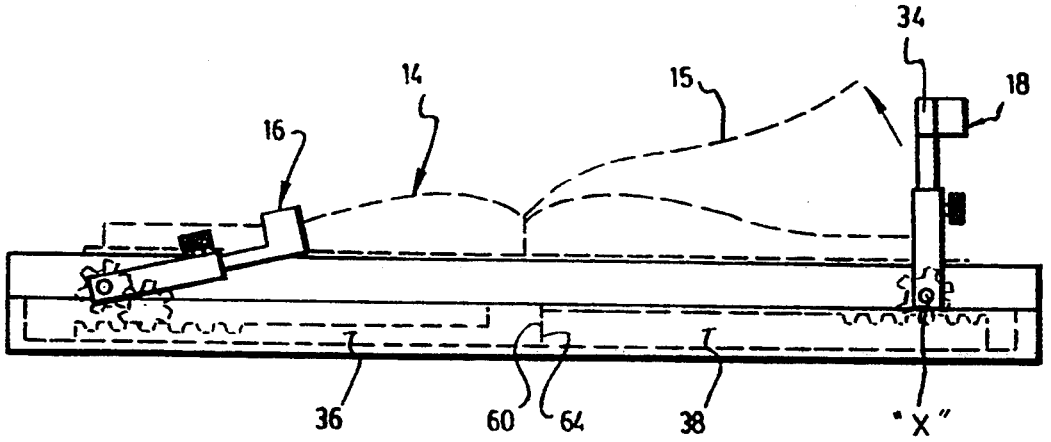
Figure 3C:
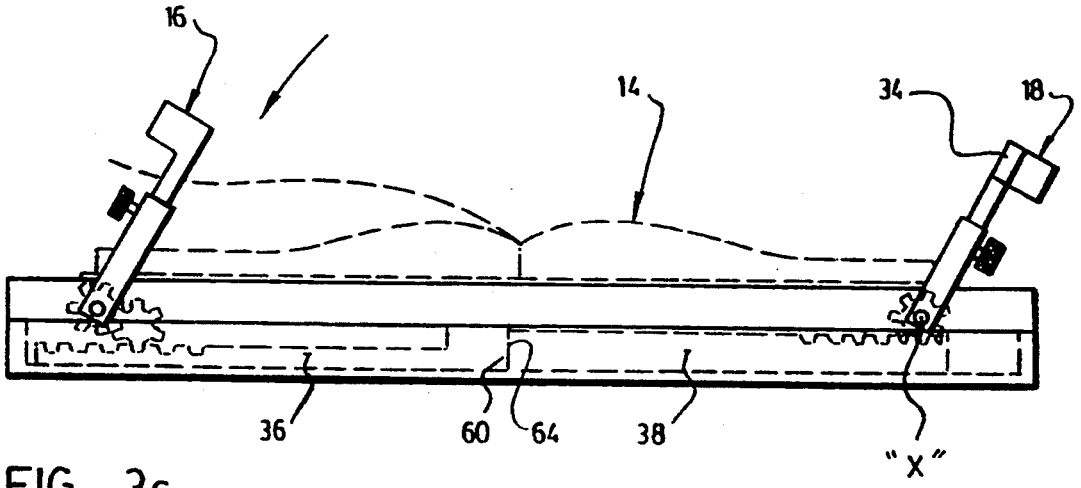

The book holder 10 according to the present invention further comprises a mechanism mounted onto the frame 12 for opening and closing the aforesaid right and left page holders, 16 and 18. As shown in FIG. 1, this mechanism comprises a lever 34 connected to the finger 26 of the right page holder 18 for opening the same. As shown in FIG. 3*a* to 3*c*, this mechanism also comprises a first horizontally extending rack 38 having an end 58 operatively connected to the right page holder 18 via a pinion 44, and another opposite end 60 extending toward a second horizontally extending rack 36 that is in line with the first rack 38. This second horizontally extending rack 36 has an end 62 connected to the left page holder 16 via a set of two intermeshed pinions 40 and 42, and another opposite end 64 which, as is shown in FIG. 3*a*, is normally located at a predetermined distance "d" away from the end 60 of the rack 38.

In operation, as shown in FIG. 3*b* and FIG. 3*c*, when the lever 34 is pulled away from the book holder 10 using line "X" as a pivot axis, the rack 38 slides until its end 60 touches the end 64 of the rack 36. During that time, that is just before the opening of the left page holder 16, the user can turn right hand side page 15 of the book 14.

Thereafter, as shown in FIG. 3*c*, by continuing on pulling the lever 34, the end 60 of the rack 38 pushes against the end 64 of the rack 36 thereby slowly opening the left page holder 16. As it can be understood, the aforesaid distance "d" separating the ends of the racks, 60 and 64, allows a delay in the opening of the left page holder 16. When the left page holder 16 is partially opened, the user can put the page of the book to be turned under the fingers, 20 and 22, for retainment. By continuing on pulling the lever 34 away from the book holder 10 using line "X" as the pivot axis, both pager holders 16 and 18 are opened, as thereby allowing the user to remove the book 14 from the book resting frame 12 when he or she has finished reading.

The mechanism of the book holder also comprises two return springs (only one spring 66 is shown in FIG. 4*a*). Each spring is connected between the corresponding page holder and the book resting frame 12 and serve for permanently biasing the page holders 16 and 18 back to a closed position where the fingers 20, 22, 24 and 26 bear against the book 14 or the book resting frame 12 when the book has been removed therefrom.

As can be apparent, the above-described mechanism for opening and closing the right and left page holders is for use by a right-handed person. However, by connecting the lever 34 to the book holding finger 22 and operatively connecting the end 58 of the rack 38 to the right page holder via two intermeshed pinions and the end 62 of the rack 36 to the left page holder via only one pinion, the book holder can be modified for use by a left-handed person.

Of course, the adjustable book holder 10 according to the present invention is provided with a guiding mechanism for holding each of the aforesaid racks 36 and 38 and for controlling sliding of the same when the lever 34 is pulled. This guiding mechanism comprises a slot 49 (see FIG. 3*a*) extending lengthwise inside the first book resting frame member 48 and is sized and shaped to receive both racks. As can be apparent to those skilled in the art, any other suitable guiding mechanism, such as U-shaped members having ends connected to the frame and defining passages whereby the two racks 36 and 38 may be guided, could also be used for controlling sliding of said racks.

Figure 2:
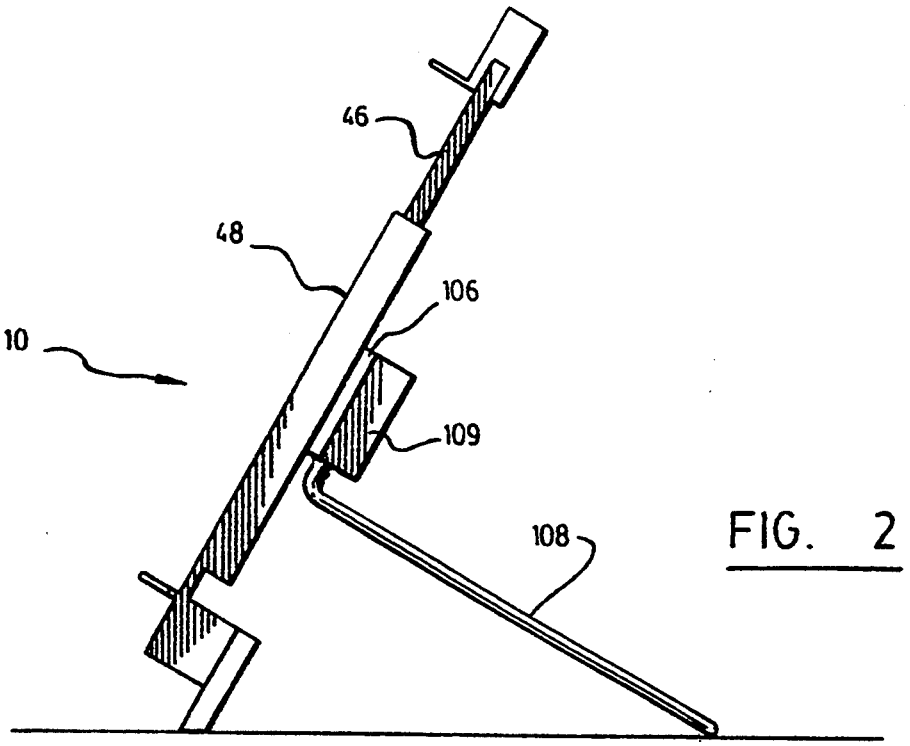
FIG. 2 s a side view of the book holder of FIG. 1 showing a supporting leg for supporting the same.
Figure 5:
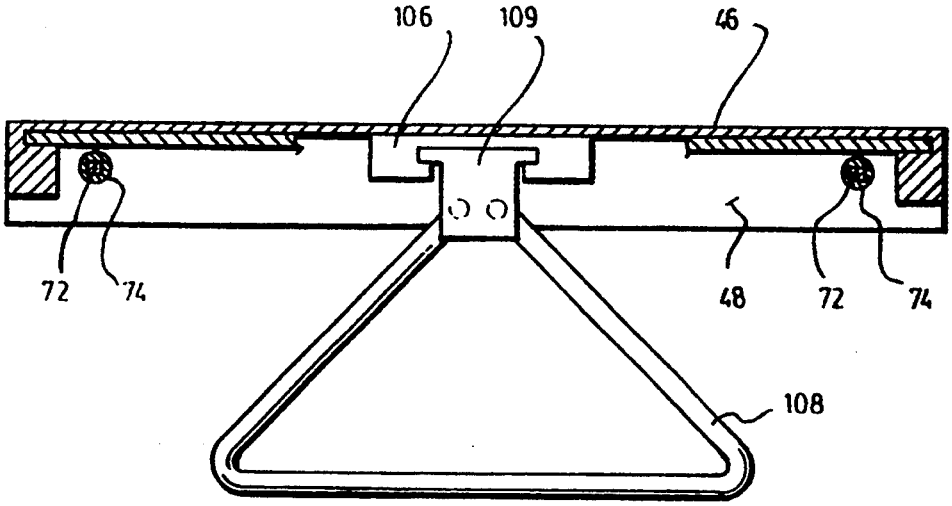
FIG. 5 is a top view of the book holder of FIG. 1.

The adjustable book holder 10 can be provided with a supporting leg 108, shown in FIGS. 2 and 5 having a T-shaped connecting member 109 which can be connected to a hook 106 fixed to the back of the book resting frame 12. The aforesaid supporting leg 108 can be used for supporting the book resting frame 12 on a table, or on any predetermined object having a flat surface. Furthermore, the supporting leg 108 can be made adjustable to allow the user to adjust the angular position of the book resting frame 12 supported on a table.

Figure 7:
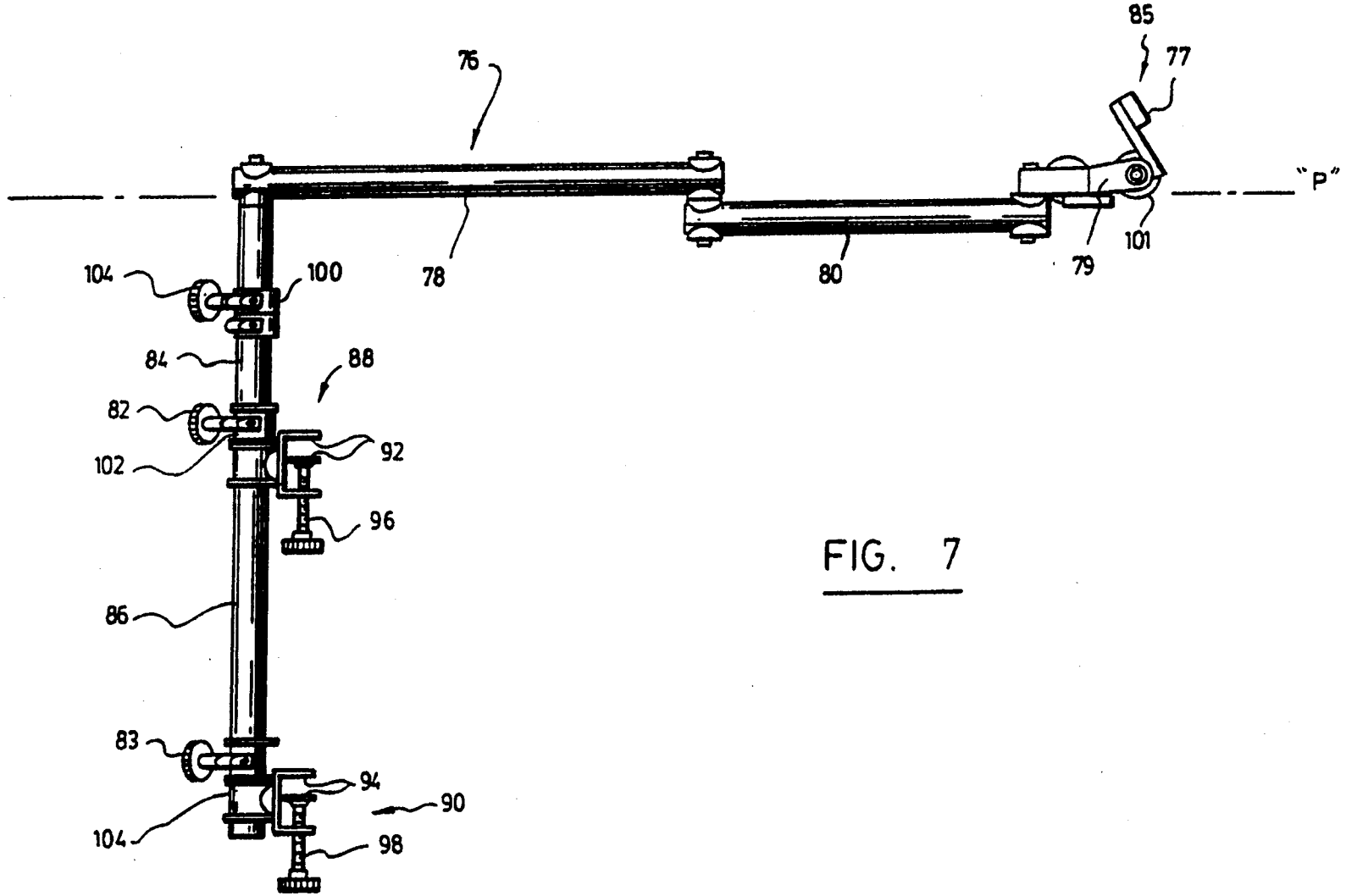
FIG. 7 is a perspective view of an articulated adjustable arm for supporting the book holder according to the invention.
Figure 8:
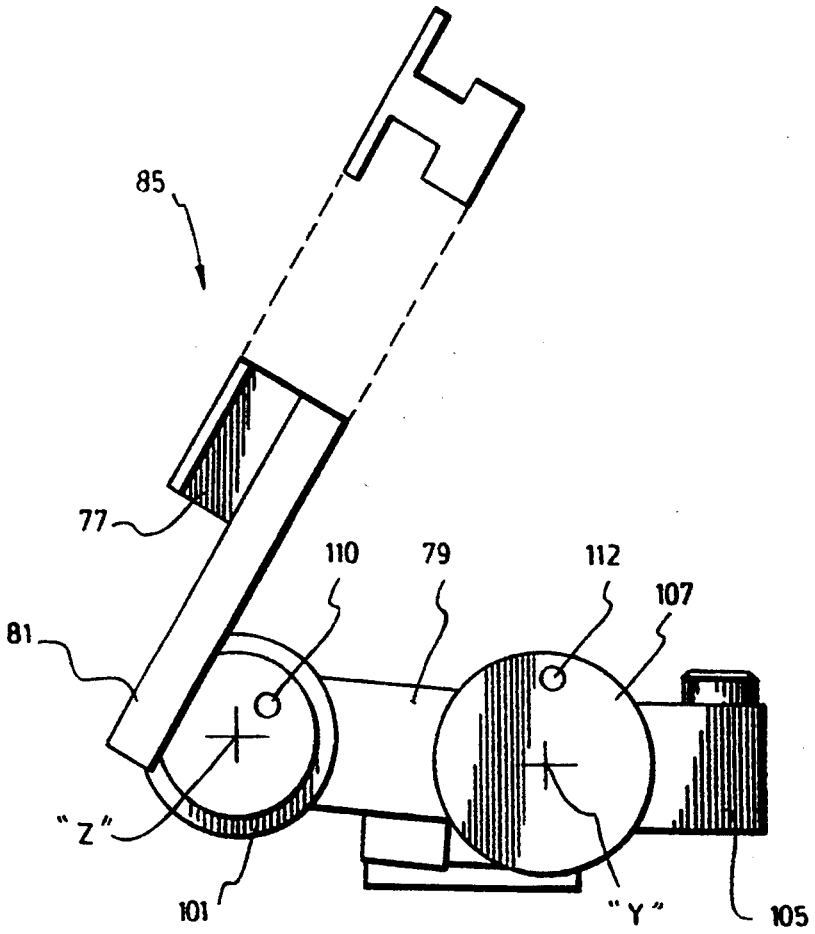
FIG. 8 is an enlarged cross-sectional front view of the connecting member of the articulated adjustable arm of FIG. 7.

Alternatively, the book holder 10 can be provided with an articulated adjustable arm 76, shown in FIG. 7, for supporting the book resting frame in a predetermined position. This adjustable arm 76 comprises two horizontally extending, pivotally interconnected arm members 78 and 80, two vertically extending, telescopically interconnected arm members 84 and 86, and a frame attaching member 85 pivotally connected to the arm member 80. The arm attaching member 85 serves for connecting the adjustable arm 76 to the back of the book resting frame 12 and is provided with a supporting member 79 and a T-shaped connecting member 77 for connection to the hook 106. As is better shown in FIG. 8, the T-shaped connecting member 77 is pivotally connected to the supporting member 79 via a circular plate 101 and a supporting plate 81. The circular plate 101 has a threaded opening 110 for receiving a circular plate thumb screw (only the opening 110 for the circular plate thumb screw is shown in FIG.8). Also, the supporting member 79 is provided with a threaded opening (not shown) aligned with the opening 110 for receiving the aforesaid circular plate thumb screw.

The supporting member 79 is pivotally connected to an interconnecting arm member 105 via a second circular plate 107. This interconnecting arm member 105 is provided with a threaded opening 112 for receiving a member thumb screw (not shown), and which is aligned with a second threaded opening provided in the supporting member 79 for receiving the same.

In operation, because of the pivotal connection between the T-shaped connecting member 77 and the supporting member 79, the book holder 10 can be readily adjusted with respect to a pivot point "Z". Then by tightening the circular plate thumb screw in the opening 110, the book resting frame 12 can be firmly held at the desired reading position.

Furthermore, in operation, the book holder 10 can be adjusted with respect to a pivot point "Y". By tightening the other member thumb screw in the other opening 112, the book resting frame 12 can be firmly held at a second selected position.

The aforesaid pivotally interconnected arm members 78 and 80 allow adjustment of the position of the book holder 10 in a horizontal plane "P". Furthermore, the telescopically interconnected arm members 84 and 86 allow vertical position adjustment of the book holder 10. As shown, a tightenable holding member 100 provided with an adjustable screw 104 is used to firmly hold the book holder 10 at the desired vertical position.

The adjustable arm 76 further comprises one or more C-shaped clamps 88 and 90 provided with corresponding clamping plates 92 and 94, and with thumb screws 96 and 98. This makes it possible to attach the arm 76 to a variety of home furnishings, such as beds, tables and other supporting environments, such as posts for instance, thereby allowing very comfortable reading periods. As shown, the C-shaped clamp is connected to tightenable holding members 102 and 104 respectively, provided with holding screws 82 and 83. These holding members 102 and 104 are slidably mounted onto the arm member 84 and serve for adjusting the position of C-shaped clamps 88 and 90, for attachment to various objects mentioned hereinabove.

As can be appreciated, there are various advantages to the adjustable book holder according to the present invention. In addition to being adaptable for use with any type of soft cover and hard cover books, various magazines and the like, the adjustable book holder is devised to be easily transported or stored until it is to be used again.

Furthermore, because of the above-described arm attaching member and the page holders, the user can readily adjust the position of the book resting frame with the book thereon, even while lying in bed.

In connection to the above-mentioned advantages, the book holder can be very useful in libraries, schools, corporations and in any field where it might be desirable to study a book, magazine, periodical or other manuscript for the comfort of the user or when it is desirable for the user to have his hands free for making or taking notes, dictating etc.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

The embodiments of the invention in which an exclusive property or privilege is claimed are defined as follows:

1. An adjustable book holder comprising:

a book resting frame comprising two horizontally extending book supporting brackets;

means for vertically adjusting at least one of said brackets with respect to the other;

a vertically adjustable telescopic left page holder rotatably connected to said frame and having two opposite extremities, at least one of said extremities being provided with a horizontally adjustable book holding finger for retaining left side pages onto said book resting frame;

a vertically adjustable telescopic right page holder rotatably connected to said frame and having two opposite extremities, at least one of said extremities being provided with a horizontally adjustable book holding finger for retaining right side pages onto said book resting frame;

means for supporting said book resting frame in a predetermined position; and means mounted on said frame for opening and closing said right and left page holders, said means comprising:

a lever connected to one of the page holders for opening the same;

a first horizontally extending rack having one end operatively connected to the one page holder via one pinion and another opposite end extending toward the other one of said page holders;

a second horizontally extending rack in line with the first rack, said second rack having one end operatively connected to the other one of said page holders via a set of two intermeshed pinions and another opposite end extending toward the one page holder and located at a predetermined distance away from the opposite end of said first rack for pushing against the same; and spring means for permanently biasing the page holders back to a closed position where said fingers bear against said frame or the book resting on it when said lever is released after it has been pulled, each spring means being connected between the corresponding page holder and the book resting frame;

whereby, when the lever is pulled said second rack slides on said frame, and its opposite end pushes against the adjacent opposite end of said first rack and said predetermined distance between said opposite ends allows a delay in the opening of the other one of said page holders.

2. An adjustable book holder according to claim 1, wherein said frame comprises a first book resting frame member including one of the two book supporting brackets and provided with two vertically extending guiding slots, and a second book resting frame member including the other one of said book supporting brackets and having two opposite ends; and said adjusting means comprise the two guiding slots of the first frame member and the two ends of the second frame member that are slidably mounted within the corresponding guiding slots and frictionally engage with the same.

3. An adjustable book holder according to claim 1, further comprising guiding means for holding each of said first and second racks and controlling sliding of the same when said lever is pulled.

4. An adjustable book holder according to claim 3, wherein said guiding means comprise a slot extending lengthwise inside said frame, which is sized and shaped to receive said first and second racks.

5. An adjustable book holder according to claim 1, wherein the one page holder is said right page holder, the other one of said page holders is said left page holder and said lever is connected to said right page holder, thereby allowing a right-handed person to use the adjustable book holder.

6. An adjustable book holder according to claim 1, wherein the one page holder is said left page holder, the other one of said page holders is said right page holder and said lever is connected to the left page holder, thereby allowing a left-handed person to use the adjustable book holder.

7. An adjustable book holder according to claim 1, wherein said means for supporting comprise an articulated adjustable arm.

8. An adjustable book holder according to claim 7, wherein said book holder further comprises hooks connected at a back of said book resting frame; and wherein said articulated adjustable arm includes:

two horizontally extending pivotally interconnected arm members and two vertically extending telescopically interconnected arm members, one of the vertically extending arm members being pivotally connected to one of the two horizontally extending arm members;

an arm attaching member pivotally connected to one of the two horizontally extending arm members, said arm attaching member being provided with a supporting member having a threaded opening for receiving a circular plate thumb screw, a T-shaped connecting member for connection to said hooks and being pivotally connected to said supporting member via a supporting plate and a circular plate, said circular plate being provided with a threaded opening aligned with the threaded opening of the supporting member for receiving said circular plate thumb screw;

two holding members slidably mounted onto the other one of the two vertically extending arm members and provided with holding screws; and two C-shaped clamps provided with thumb screws and connected to the corresponding holding members, whereby, in operation, after the adjustable arm has been attached by means of the C-shaped clamps to a predetermined object, the arm attaching member allows the user to adjust the position of the book resting frame, and by tightening the circular plate thumb screw keep the same firmly at a desired reading position.

* * * * *